United States Patent [19]

Hay, II et al.

[11] 4,225,171

[45] Sep. 30, 1980

[54] ELECTROMAGNET TOOL FOR RETRIEVING MAGNETIC OBJECTS FROM AN EARTH CAVERN

[75] Inventors: Robert A. Hay, II; John A. DeBliek, both of Midland, Mich.

[73] Assignee: The Dow Chemical Company, Midland, Mich.

[21] Appl. No.: 956,116

[22] Filed: Oct. 30, 1978

[51] Int. Cl.[3] ..... B66C 1/06

[52] U.S. Cl. ..... 294/65.5

[58] Field of Search ..... 294/65.5, 86.1, 86.13, 294/86.14; 335/291, 305

[56] References Cited

U.S. PATENT DOCUMENTS

| | | | |
|---|---|---|---|
| 2,092,316 | 9/1937 | Lane | 294/65.5 |
| 2,637,590 | 5/1953 | Ortloff | 294/65.5 |
| 2,733,948 | 2/1956 | Russell | 294/65.5 |
| 4,105,239 | 8/1978 | Akczinski, Sr. | 294/65.5 |

*Primary Examiner*—James B. Marbert

*Attorney, Agent, or Firm*—V. Dean Clausen

[57] ABSTRACT

The electromagnet tool described herein is useful for retrieving magnetic objects lost in earth caverns. The tool includes a magnet face that combines at least one flat surface with another surface that conforms to the general shape of the lost object. For example, in one embodiment, the magnet face is defined by two flat surfaces with a semicircular groove between the flat surfaces. This configuration enables the tool to readily locate and attach itself to a cylindrical object. The tool can also be equipped with a rudder assembly, or a "beaver tail" guide, to improve its ability to fish around for a magnetic object lost in a cavern filled with liquid.

2 Claims, 4 Drawing Figures

ELECTROMAGNET TOOL FOR RETRIEVING MAGNETIC OBJECTS FROM AN EARTH CAVERN

BACKGROUND OF THE INVENTION

The invention relates broadly to a tool for recovering magnetic objects from an earth cavern. More specifically, the invention provides an electromagnet tool particularly adapted for recovering magnetic objects from earth caverns filled with liquids.

There are several commercially available tools in which permanent magnets or electromagnets are used to retrieve magnetic objects from underground holes, such as bore holes for oil or gas wells. Most of these tools are designed for picking up drilling rig parts, such as drill bits, which come loose or break off during drilling operations and drop to the bottom of the bore hole. Since the object to be retrieved is lodged in the bore hole itself, the magnetic tool can be lowered in a direct line, that is, through the well casing, until it makes contact with the object. In some underground operations, however, tools or other metallic objects may be lost in a cavern, such as a brine well cavern. If the object in the cavern should be in a position which is not in a direct line with the well casing, it can be extremely difficult or impossible to maneuver the magnetic tool into a position where it can make contact with the lost object.

Another drawback of many of the conventional magnetic tools is that the magnet surface area is small, or the shape of the magnet surface may be such that the tool will pick up only specific objects, such as a drill bit. The tool of the present invention overcomes most of the problems described above. For example, the pickup surface of the electromagnet used in the present tool is designed such that it will attach to magnetic objects of various shapes and sizes. In addition, the present tool may be equipped with various guide means which enable it to maneuver in a cavern until it locates the lost object.

SUMMARY OF THE INVENTION

The tool of this invention is useful for recovering magnetic objects from an earth cavern. In the embodiment described herein the tool includes an elongate magnet with a wire coil wrapped around it to provide an electromagnet assembly. The North and South poles of the magnet, which are separated, define a magnet face with at least one flat surface. The electromagnet assembly is enclosed by a shield, with the inner wall surface of the shield being spaced from the wire coil.

The space between the shield and the wire coil is filled with a flexible material, to prevent damage to the coil. The top end of the shield is adapted for fastening onto a draw line for lowering the electromagnet tool into the cavern and retrieving the tool after it has attached to the lost object. An electrical lead from the wire coil is positioned inside the draw line, and this lead connects into a source of power. In a typical operation the electromagnet tool is lowered on the draw line through a well casing and into the earth cavern. Once the tool locates the magnetic object in the cavern, the magnet face provides a contact surface which will attach to the object to be retrieved.

DESCRIPTION OF A PREFERRED EMBODIMENT

Figure 1:
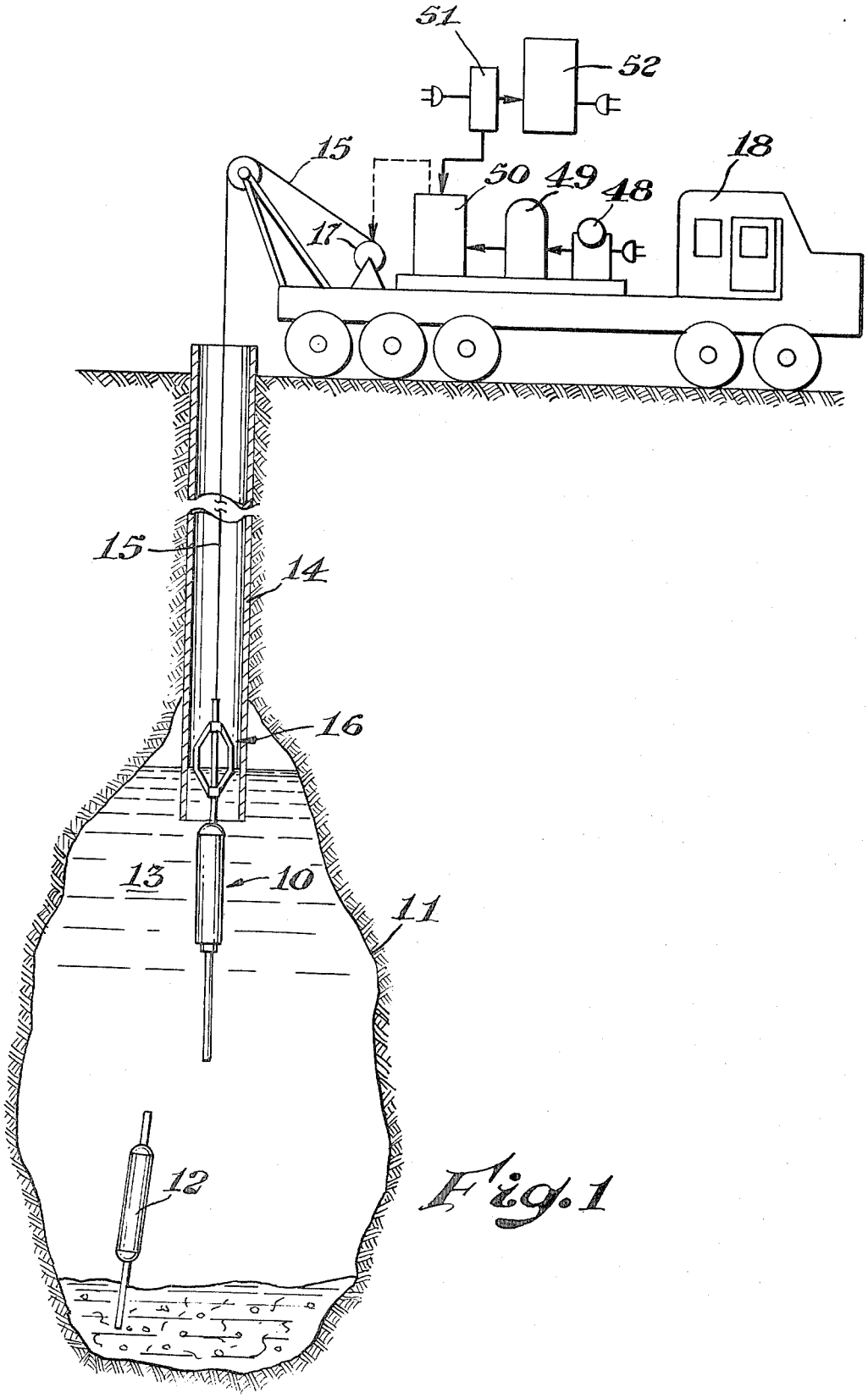
FIG. 1 is an elevation view, in schematic, which illustrates use of the electromagnet tool of this invention to recover a magnetic object from an earth cavern.

Referring now to the drawing, particularly FIG. 1, the numeral 10 generally designates the electromagnet tool of this invention. In FIG. 1 the tool 10 is illustrated as being lowered into an earth cavern 11 to retrieve a magnetic object 12, which has been lost in the cavern. The cavern in FIG. 1 is illustrated as being filled with a liquid 13. The tool 10 is lowered into the cavern through a well casing 14 on a cable line 15, or some other suitable draw line. One end of the cable 15 passes through a centering guide 16 and is fastened into the top end of the tool 10. The opposite end of the cable is engaged by a power winch 17. The winch is mounted on a service vehicle 18 which is located on the surface of the earth next to the well head.

The embodiment of tool 10, as illustrated generally in FIGS. 2 and 4, will now be described. The outside of the tool is defined by a shield 19, preferably a metal shield, which encloses an electromagnet assembly. This assembly consists of an elongate, steel "horseshoe" magnet 20 and a coil of fine copper wire 21, which is wrapped lengthwise around the magnet. Power is carried to the magnet through an electrical lead (not shown), which runs from the coil 21 up through the cable line 15 and connects into an instrument panel. The instrument panel, which is described later, is located on or near the service vehicle 18. The power circuit from coil 21 and back to the instrument panel is completed through cable 15.

Figure 4:
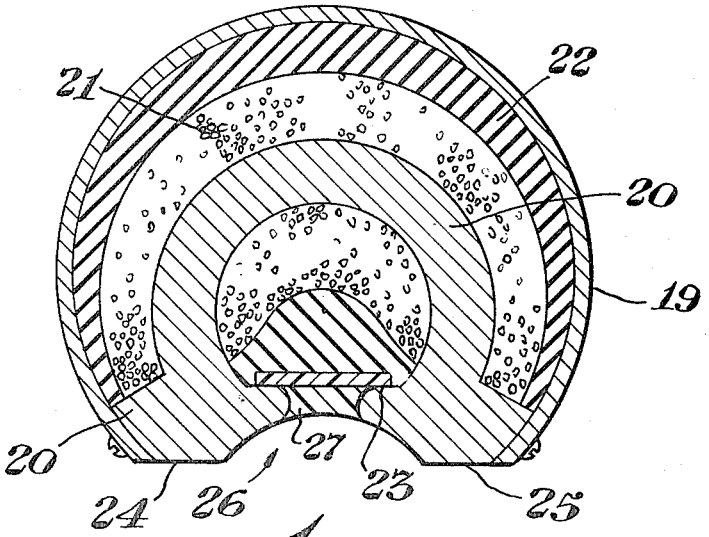
FIG. 4 is a cross section view of the electromagnet tool taken on line 4—4 of FIG. 2.

Referring particularly to FIG. 4, a flexible rubber-like material 22 is packed between the inner wall surface of shield 19 and the back side of the wire coil 21. This same rubber-like material is packed along the front side of the wire coil between the wire and the back side of a flat plastic strip 23. The purpose of the rubber packing is to prevent damage to the wire coil from pressure exerted against the coil when the tool is used in a cavern filled with liquid.

The North and South poles of magnet 20 each define a flat surface, as indicated by numerals 24 and 25. Each flat surface is contiguous with an inwardly curved surface. The curved surfaces thus define a semicircular groove between the flat surfaces, as indicated generally by numeral 26. The curved surfaces of magnet 20 further define lip portions on each of the magnet poles. The space between the lip portions is bridged by the plastic strip 23 and is filled with a resin material 27 which is packed against the front side of the strip. That part of the resin 27 which is exposed defines the bottom of the semicircular groove 26.

The combination of the flat surfaces 24 and 25 and the groove 26, which is defined by the curved surfaces, provides a magnetic face particularly adapted for locating and attaching to a cylindrical object. However, the invention is not limited to a magnetic face of this configuration. As explained later in this description, the magnet face can be designed such that it will pick up objects of many different shapes and sizes.

The bottom end of shield 19 is defined by a cap 28. The bottom side of the cap includes integral hanger brackets 29, 30, as shown in FIG. 3. Only one of the hanger brackets, indicated by numeral 30, is shown in the view of FIG. 2. The embodiment of FIG. 2 also includes a rigid leg member, which consists of a pipe section 31. The top end of the pipe section fastens into a solid block 32 and the bottom end into a flange 33. Block 32 is secured between hangers 29, 30, by a pin 34. In some retrieval operations it is desirable for the leg member 31 to remain stiff during maneuvering of tool 10 in the cavern. In these situations, one or more shim blocks, indicated by numeral 35, are fastened between the top of block 32 and the bottom of cap 28. In certain other operations, it may be desirable for the leg member to be able to pivot at the top end. When the pivot arrangement is desired, the shim blocks are removed.

Figure 2:
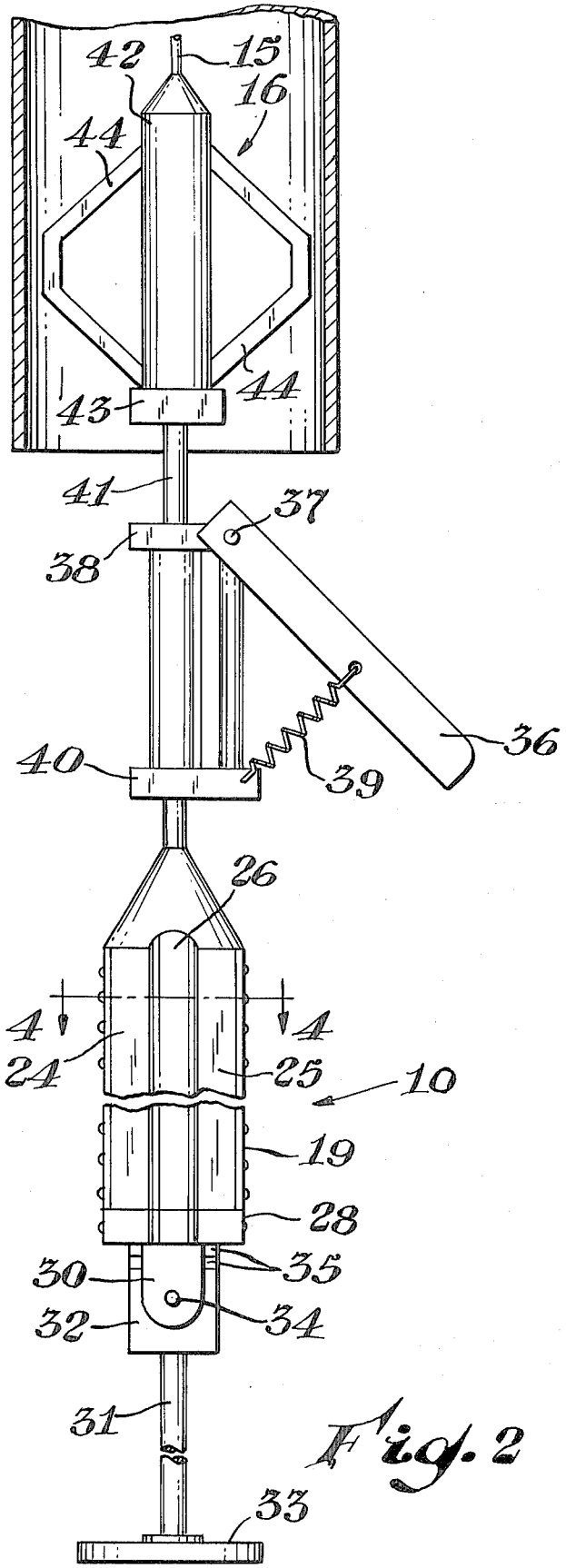
FIG. 2 is an elevation view, partly in section, of one embodiment of the electromagnet tool, in which the tool includes a rudder assembly and leg member.
Figure 3:
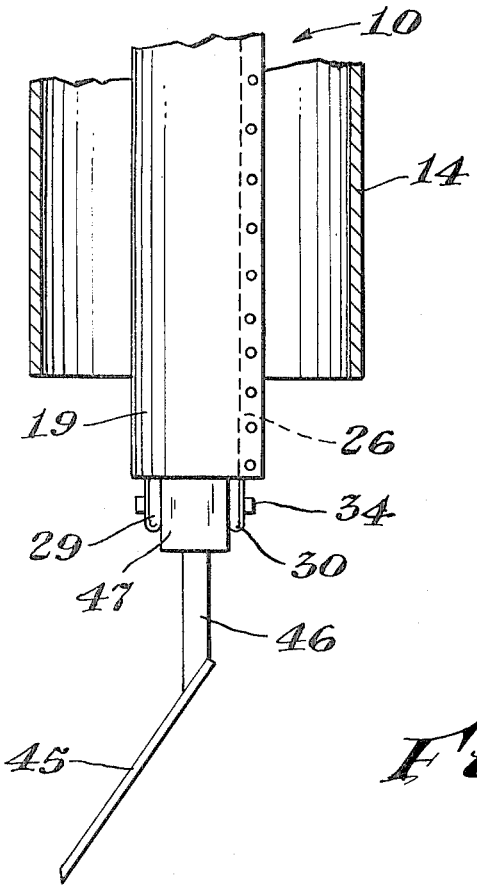
FIG. 3 is a detail view of the bottom end of the electromagnet tool. This view illustrates another embodiment in which the tool includes a "beaver tail" guide member.

Looking further at the embodiment of FIG. 2, the tool 10 includes a rudder assembly. This assembly consists of two spaced apart rudder members 36. Only one of the rudder members (36) is shown in the drawing. A pivot pin 37 fastens the rudder members on opposite sides of a split block fitting 38. In addition, each rudder is connected by a coil spring 39 to a second split block fitting 40. Only one of the coil springs (39) is illustrated in the drawing. The entire split block structure clamps the rudder assembly around a shaft 41, which extends above the top end of shield 19. In caverns filled with liquids, the rudder members 36 make it possible to divert the electromagnet tool from the working plumb line of the cavern (the center line of casing 14). The rudder assembly thus enables the tool 10 to "fish" around for the object lost in the cavern.

The centering guide structure 16 consists of a hub 42 which has a split block base 43. The base 43 clamps around an extension of the shaft 41 to hold the guide 16 in place. The centering guide also includes four flat wing members 44 which are secured to the hub 42 at equally spaced points on the hub. Only two of the wing members (44) are illustrated in the drawing. In actual practice, the wing members 44 keep the tool 10 and the attached object 12 centered in the well casing 14 as the structure is hauled to the surface by winch 17. As the tool 10 is being hauled up, the rudder members 36 will hit against the bottom end of casing 14 and pivot inwardly and downwardly toward the top of shield 19. This arrangement enables the rudder assembly to pass up through the casing 14.

In the embodiment illustrated in FIG. 3, the tool 10 is equipped with a "beaver tail" guide member. The beaver tail guide provides another means by which the tool 10 can be diverted from the plumb line, so that it can fish around in a cavern filled with liquid. The beaver tail structure consists of a flat blade 45, which is fastened at one end to the bottom end of a shaft 46. In turn, the upper end of shaft 46 fits into a solid block 47 and the block is secured between hangers 29 and 30 by the pin 34. As shown in FIG. 3, the blade 45 sets at an oblique angle to the vertical axis of tool 10 and the view is along one edge of the blade.

OPERATION

The invention can be illustrated by describing a typical operation in which the tool 10 is used to retrieve a magnetic object 12 from an earth cavern 11. In the example described herein the object 12 is a logging instrument, which was stuck in a mud layer at the bottom of the cavern. This instrument is a cylindrical device which is about two inches in diameter and about 20 feet in length. The cavern was filled with salt brine (13), and the cavern floor was over 8,000 feet below the surface of the earth.

The power circuit for the electromagnet is made up of components located either on the service vehicle 18, or near the vehicle. As shown in FIG. 1, these components include a powerstat 48, which is connected into a service line (115 v. AC), or some other suitable power source (not shown). The next component in the circuit is a transformer 49, which steps up the voltage according to the "power" requirements of the magnet. From the transformer the current passes through a rectifier and a voltmeter and ammeter, which are located in an instrument panel 50. The rectifier, and the voltmeter and ammeter are not shown in the drawing.

As the AC current passes through the rectifier in panel 50 it is converted to direct current, which is carried to the coil 21, through an insulated electrical lead positioned inside the cable line 15. During the "fishing" operation, the current variation in the magnet circuit is amplified by an amplifier 51 sufficiently to produce a signal level high enough to be picked up by a recorder 52. By continuously monitoring and recording the signal, the operator in the service vehicle can tell when the electromagnet makes contact with the lost object. The monitoring procedure also enables the operator to tell when the retrieved object drops off the electromagnet tool, if this should occur.

As mentioned earlier, there are several features of the present tool which give it a distinct advantage over the tools now available for retrieving objects which are lost underground. A particularly significant feature of this tool is its ability to maneuver inside a cavern while probing for a lost object. To explain further, the leg 31 and flange 33 allows the tool 10 to sit on top of any mud layer on the floor of the cavern, so that the tool will not sink into the mud.

For example, in a typical "fishing" operation, when the flange 33 sits on the floor of the cavern, the cable line 15 can be slackened, so that the tool 10 will tilt toward the cavern floor. As the tool tilts, the rudder members 36, which are positioned on the opposite side of the tool from the magnet face, thus steer the magnet face toward the cavern floor. This feature enables the electromagnet tool to more easily locate an object which might be lying flat on the cavern floor. The beaver tail 45 also enables the operator to steer the magnet face of the tool toward the cavern floor. As described earlier, guiding of the tool in this manner is accomplished by mounting the blade 45 such that the blade angle slopes away from the magnet face, as illustrated in FIG. 3.

Since the magnet face illustrated herein is defined by a combination of flat surfaces 24 and 25, and a groove 26 between the flat surfaces, this configuration is particularly adapted for picking up cylindrical objects, such as the logging instrument 12. For example, the flat surfaces provide a good surface for locating and making initial contact with a cylindrical object, or objects of other shapes, regardless of the position of the object. However, to enable the tool 10 to pick up the instrument 12, the magnet face must include a surface which generally conforms to the shape of the cylinder, such as the semicircular groove 26. The same general condition applies to retreiving objects having other shapes, such as square, rectangular, trianglular, and the like. For example, if the lost object has a triangular shape, the magnet face could have flat surfaces for locating the object, but the face should include a surface which is triangular in cross section, so that the triangular object can attach firmly to the magnet face.

Another feature of the present tool is the ability to retrieve magnetic objects from caverns which are filled with either gases or with liquids. Understandably, if the tool is used to retrieve objects from caverns containing only gases, it would not be necessary to use either the rudder assembly attachment or the beaver tail guide. These attachments are designed primarily for use in maneuvering the tool in a liquid medium.

Another advantage of this tool is its ability to operate in corrosive liquids, or electroconductive liquids, and under conditions of high pressure and high temperature. For example, in a cavern filled with salt brine, which is an electroconductive liquid, the temperature could be as high as 125° F. and the pressure could exceed 4500 psi. A pressure force of this level is high enough to collapse the metal shield against the coil wires 21, and thereby cause a short in the magnetic field. To avoid this pressure damage the spaces between each of the coil wires 21 and between the coil wires and the shield 19 are filled with a flexible, rubber-like material 22. A suitable material for this purpose is an organo-silicone polymer composition, sold under the tradename Silastic (Dow Corning Corporation). In the practice of this invention the silicone material was packed around the magnet coil by a conventional vacuum potting technique.

The invention claimed is:

1. An electromagnet tool for recovering magnetic objects from an earth cavern filled with liquid, the tool comprising:

an elongate magnet having a North pole and a South pole, each pole defining a flat surface which is joined to an inwardly curved surface, the respective curved surfaces defining a semi-circular groove between the flat surfaces, and the combination of the flat surfaces and the semi-circular groove defining a magnetic face on the magnet;

a wire coil which is wrapped around the magnet, and which is connected by an electrical lead to a source of electrical power, to provide an electromagnet;

a metal shield having a top end and bottom end, the shield enclosing the electromagnet and being spaced from the wire coil;

a flexible material which is positioned between the metal shield and the wire coil;

the top end of the metal shield being adapted for fastening into a draw line, and the electrical lead from the wire coil to the power source being positioned inside the draw line;

a guide member defined by a flat blade which is fastened to the bottom end of the metal shield, and is set an an oblique angle to the axis of said shield; and the tool being adapted for lowering on the draw line through a casing member into the earth cavern, and the magnet face providing a contact surface for retrieving magnetic objects from the earth cavern.

2. An electromagnet tool for recovering magnetic objects from an earth cavern filled with liquid, the tool comprising:

an elongate magnet having a North pole and a South pole, each pole defining a flat surface which is joined to an inwardly curved surface, the respective curved surfaces defining a semi-circular groove between the flat surfaces, and the combination of the flat surfaces and the semi-circular groove defining a magnetic face on the magnet;

a wire coil which is wrapped around the magnet, and which is connected by an electrical lead to a source of electrical power, to provide an electromagnet;

a metal shield having a top end and bottom end, the shield enclosing the electromagent and being spaced from the wire coil;

a flexible material which is positioned between the shield and the wire coil;

the top end of the shield being adapted for fastening into a draw line, and the electrical lead from the wire coil to the power source being positioned inside the draw line;

a rudder assembly which is positioned on a coupling member extending above the top end of the metal shield, and which is adapted to pivot downwardly toward shield; and a leg member which is pivotally connected to the bottom end of the metal shield, and which extends downwardly from said shield; and the tool being adapted for lowering on the draw line through a casing member into the earth cavern, and the magnet face providing a contact surface for retrieving magnetic objects from the earth cavern.

* * * * *